US011814886B2

(12) United States Patent
Schweiss

(10) Patent No.: US 11,814,886 B2
(45) Date of Patent: Nov. 14, 2023

(54) BI-FOLD DOOR LATCH ASSEMBLY

(71) Applicant: Michael L. Schweiss, Fairfax, MN (US)

(72) Inventor: Michael L. Schweiss, Fairfax, MN (US)

(73) Assignee: SORREL QUARTERS, LLC, Hector, MN (US)

( * ) Notice: Subject to any disclaimer, the term of this patent is extended or adjusted under 35 U.S.C. 154(b) by 759 days.

(21) Appl. No.: 16/838,884

(22) Filed: Apr. 2, 2020

(65) Prior Publication Data

US 2020/0256106 A1 Aug. 13, 2020

Related U.S. Application Data

(62) Division of application No. 15/875,776, filed on Jan. 19, 2018, now Pat. No. 10,815,711, which is a division of application No. 15/067,431, filed on Mar. 11, 2016, now Pat. No. 10,053,901.

(60) Provisional application No. 62/193,706, filed on Jul. 17, 2015.

(51) Int. Cl.

| | |
|---|---|
| ***E05D 15/26*** | (2006.01) |
| ***E05B 65/00*** | (2006.01) |
| ***E05F 15/605*** | (2015.01) |
| ***E06B 3/48*** | (2006.01) |
| ***E05D 13/00*** | (2006.01) |
| *E05F 15/67* | (2015.01) |
| *E05F 15/681* | (2015.01) |

(52) U.S. Cl.

CPC ..... *E05D 15/264* (2013.01); *E05B 65/0085* (2013.01); *E05D 13/1207* (2013.01); *E05D 13/1223* (2013.01); *E05D 15/262* (2013.01); *E05F 15/605* (2015.01); *E06B 3/483* (2013.01); *E05F 15/67* (2015.01); *E05F 15/681* (2015.01); *E05Y 2201/43* (2013.01); *E05Y 2400/354* (2013.01); *E05Y 2600/46* (2013.01); *E05Y 2900/106* (2013.01); *E05Y 2900/108* (2013.01)

(58) Field of Classification Search

CPC ... E05D 15/264; E05D 15/266; E05D 15/262; E05D 13/1207; E05D 13/1223; E05F 15/605; E05F 15/681; E05F 15/67; E05B 65/0085; E06B 3/483; E06B 3/481; E05Y 2201/644; E05Y 2201/652; E05Y 2201/43; E05Y 2201/42; E05Y 2600/46; E05Y 2900/106; E05Y 2900/108

See application file for complete search history.

(56) References Cited

U.S. PATENT DOCUMENTS

| | | | | |
|---|---|---|---|---|
| 2,136,611 A | | 11/1938 | Cooper | |
| 2,308,150 A | | 1/1943 | Bliss | |
| 3,024,838 A | * | 3/1962 | Egleston | E06B 3/01 292/201 |

(Continued)

*Primary Examiner* — Daniel P Cahn
*Assistant Examiner* — Jeremy C Ramsey
(74) *Attorney, Agent, or Firm* — R. John Bartz

(57) ABSTRACT

A latch assembly connected to the drive unit of a bi-fold door for retaining the bi-fold door secure to a building has elongated straps attached to rotatable latch drums mounted on the outer ends of the drive shaft of the drive unit. Lift drums powered by a motor driven gearbox raise and lower the bi-fold door. Latch assemblies having springs attached to the straps maintain tension on the straps during the opening and closing of the bi-fold door.

16 Claims, 10 Drawing Sheets

(56) References Cited

U.S. PATENT DOCUMENTS

| | | | | | |
|---|---|---|---|---|---|
| 3,155,147 | A | * | 11/1964 | Smith | E05F 15/605 160/207 |
| 3,207,208 | A | * | 9/1965 | Houk | E05F 15/605 160/189 |
| 4,026,343 | A | | 5/1977 | James | |
| 4,261,409 | A | | 4/1981 | Devore | |
| 4,637,446 | A | * | 1/1987 | McQueen | E06B 3/01 160/207 |
| 4,765,093 | A | | 8/1988 | Edwards | |
| 5,168,914 | A | | 12/1992 | Keller | |
| 5,343,923 | A | | 9/1994 | Keller | |
| 5,560,658 | A | | 10/1996 | Coolman et al. | |
| 6,199,617 | B1 | * | 3/2001 | Schweiss | E05F 15/605 242/584.1 |
| 6,547,292 | B1 | | 4/2003 | Keller | |
| 6,868,080 | B1 | | 3/2005 | Schweiss | |
| 7,029,041 | B2 | | 4/2006 | Keller | |
| 7,219,711 | B2 | | 5/2007 | Keller et al. | |

* cited by examiner

BI-FOLD DOOR LATCH ASSEMBLY

CROSS REFERENCE TO RELATED APPLICATION

This application is a division of U.S. application Ser. No. 15/875,776 filed Jan. 19, 2018, now U.S. Pat. No. 10,815,711. Application Ser. No. 15/875,776 is a division of U.S. application Ser. No. 15/067,431 filed Mar. 11, 2016, now U.S. Pat. No. 10,053,901. Application Ser. No. 15/067,431 claims the priority of U.S. Provisional Patent Application Ser. No. 62/193,706 filed Jul. 17, 2015.

FIELD OF THE INVENTION

The latch assembly for a bi-fold door is in the art of apparatus for and methods of latching a bi-fold door in an upright position to close a doorway in a building.

BACKGROUND OF THE INVENTION

Buildings have large openings or doorways for accommodating vehicles, aircraft, watercraft and equipment which are moved into and out of the interior spaces in the buildings. Common types of conventional doors used to open and close the doorways are horizontally sliding doors and two piece center hinged doors known as bi-fold doors. An example of an overhead bi-fold door is disclosed by M. L. Schweiss in U.S. Pat. No. 6,866,080. The bi-fold doors have separate levers and mechanical latches operable to hold the doors in closed positions relative to the building structure.

C. E. McQueen et al in U.S. Pat. No. 4,637,446 discloses a latch member that engages a catch plate to lock a bi-fold door in an upright closed position. A spring connected to the latch member retains the latch member in locking engagement with the catch plate. A lift cable connected to the latch member extending to a door opening mechanism is used to release the latch member from the catch plate to allow the bi-fold door to swing to an open folded position. D. N. Keller in U.S. Pat. No. 5,343,923 discloses a latching assembly operable to hold a bi-fold door in an upright closed position. The latching assembly has an arm pivotally connected to the door frame that cooperates with a roller mounted on the adjacent door jamb. An actuation assembly driven by an electric motor operates to open and close the bi-fold door. The actuation assembly pulls a cable connected to the arm to pivot the arm into locking relationship with the roller on the door jamb to hold the bi-fold door in the upright closed position. The latching assembly operates with a single electric motor that performs the latching and unlatching operations automatically in cooperation with the opening and closing of the bi-fold door.

SUMMARY OF THE INVENTION

The invention is a latch assembly cooperating with a door lift mechanism to secure a bi-fold door in an upright position closing a doorway of a building. The bi-fold door has upper and lower panels hinged together to allow movement relative to each other between an upright closed position to a generally horizontal folded open position. The upper panel is hinged to a header attached to upright columns or door jambs. A lift mechanism comprising an electric motor driven shaft connect to lift drums accommodating flexible straps operates to move the door panels from upright closed positions to folded open positions to open the doorway to the interior of the building. Latch assemblies operatively connected to one of the panels of the bi-fold door have latch drums connected to the shaft and latch straps joined to the latch drums and adjacent columns hold the bi-fold door in the closed upright position. The lift mechanism straps wind on the lift drums and the latch straps unwind from the latch drums during movement of the bi-fold door from the upright closed position to the folded open position. During closing of the bi-fold door the latch straps wind on the latch drums and retain the door panels in upright closed positions in engagement with the adjacent doorway columns.

DESCRIPTION OF THE BI-FOLD DOOR WITH LIFT MECHANISMS AND LATCH ASSEMBLIES

In the following detailed descriptions of the bi-fold doors equipped with latch assemblies, reference is made to the accompanying drawing that form a part hereof, and in which are shown, by way of illustration, specific embodiments in which the invention may be practiced. It is to be understood that other embodiments may be utilized and structure changes may be made or other method steps and sequence thereof may be used without departing from the scope of the present invention. The latch assemblies are herein described as used in building environment. The latch assemblies can have uses in other environments when securing doors used to close an opening is desired.

Figure 2:
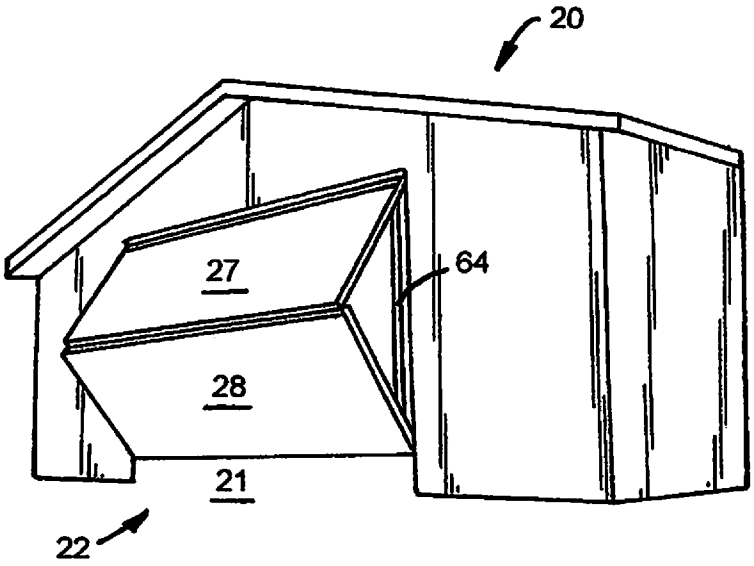
FIG. 2 is a perspective view of the bi-fold door of FIG. 1 in a partly open position.
Figure 1:
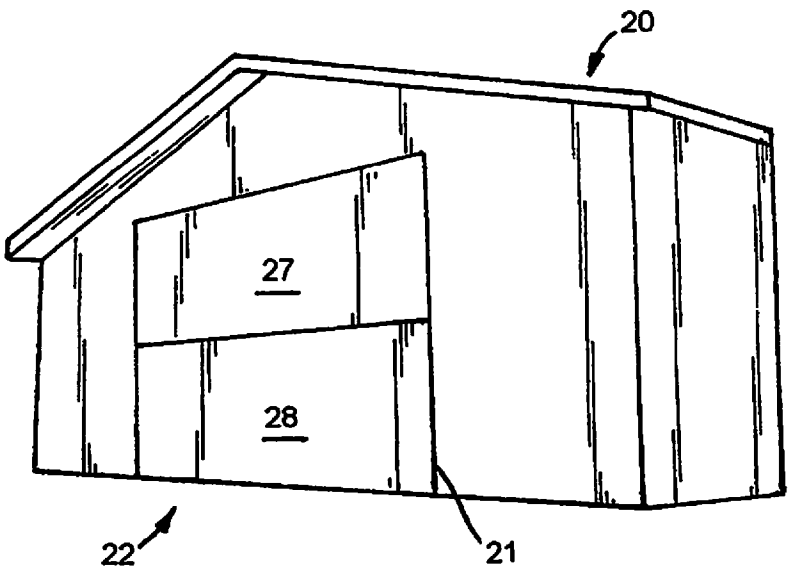
FIG. 1 is a perspective view of a bi-fold door closing a doorway of a building equipped with a door lift mechanism combined with automatic operated latch assemblies.

A building 20, shown in FIGS. 1 and 2, has a doorway 21 that is opened and closed with a bi-fold door 22. Examples of building 20 include aviation hangers, automotive shops, farm shops, commercial buildings, warehouses and commercial plants. Building 20 has a horizontal header 23 attached to upright end columns 24 and 26 located around doorway 21 open to the interior of building 20. Bi-fold door 22 has an upper panel 27 and a lower panel 28 movable between upright aligned positions to close doorway 21 and folded horizontal position to open doorway 21. Examples of bi-fold doors are disclosed in U.S. Pat. Nos. 4,637,446; 5,168,914 and 6,199,617.

Bi-fold door 22 has a metal frame 29 supporting upper and lower panels 27 and 28. Upper panel frame has top and bottom horizontal members 31 and 32 and a middle member 33 located between members 31 and 32. Upright end members 38 and 39 and upright middle members 41, 42, 43 and 44 are joined to horizontal members 31 and 32. Bottom panel 28 has top and bottom horizontal members 34 and 36 joined to end members 35. Frame members are elongated tubular beams welded to provide one-piece frames for panels 27 and 28. Sheathing 51 secured to frame 29 covers the outside of frame 29. A plurality of hinges 52 connected to frame members 32 and 34 pivotally join panels 27 and 28 for movement between an upright aligned closed position and a horizontal folded open position. A plurality of hinges 53 connected to frame member 31 and header 23 pivotally mount door 22 on header 23 for swinging movement between an upright closed position and a generally horizontal folded open position.

Figure 6:
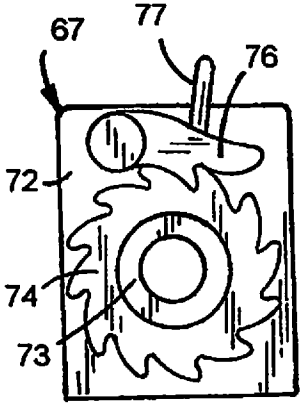
FIG. 6 is an end elevational view of the strap slack adjuster anchor for the strap of the door lift mechanism.
Figure 7:
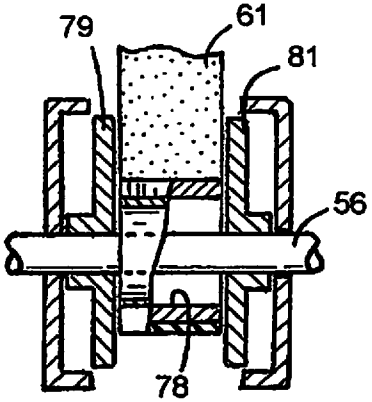
FIG. 7 is an enlarged sectional view of the lift drum and strap taken along line 7-7 of FIG. 4.
Figure 5:
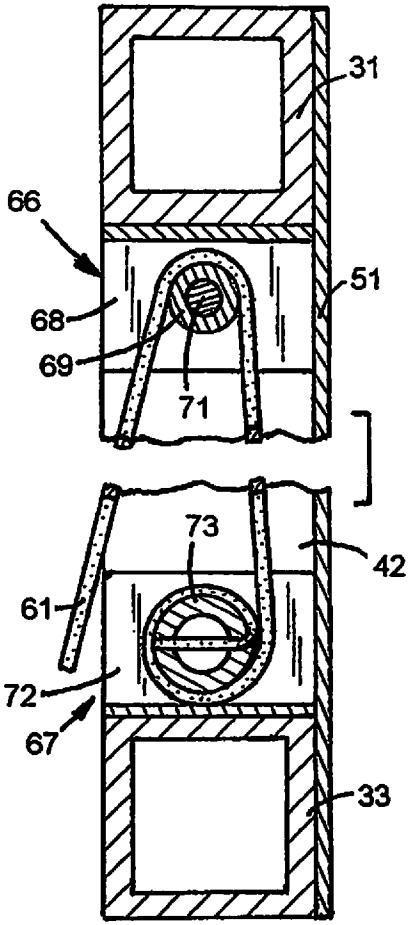
FIG. 5 is an enlarged foreshortened sectional view taken along line 5-5 of FIG. 4.

A door lift mechanism 54 functions to lift door 22 from the upright closed position to the generally horizontal folded open position. Lift mechanism 54 also retains door 22 in the open position. When lift mechanism 54 releases door 22 the weight of door 22 and lift mechanism 54 returns door 22 to a nearly closed position. Automatic latch assemblies 94 and 96 hereinafter described move panels 27 and 28 in upright aligned positions closing doorway 21 and retaining opposite sides of panels 27 and 28 in engagement with columns 24 and 26. Door lift mechanism 54 comprises a horizontal shaft 56 rotatably mounted on supports 57, 58, 59 and 60 secured to bottom member 36 of the lower panel frame. Supports 57, 58, 59 and 60 have bearings accommodating shaft 56 for rotation about a generally horizontal axis. A plurality of elongated flexible members, such as webs or straps 61, 62, 63 and 64 operatively connect shaft 56 to upper panel 27 whereby rotation of shaft 56 in one direction moves door 22 from the closed position to the open position and releases the automatic latch assemblies 94 and 96 and rotation of shaft 56 in an opposite direction to the one direction allows door 22 to move from the open position to the closed position and operating automatic latch assemblies 94 and 96 to retain panels 27 and 28 in upright aligned positions in engagement with columns 24 and 26 of building 20. As shown in FIG. 4, member 61 is an elongated flexible flat web or strap, such as a nylon or polyester web. The upper section of member 61 is trained over a support 66 secured to upper frame member 31 and terminating on an anchor 67 secured to frame member 33. As shown in FIG. 5, support 66 has an inverted U-shaped bracket 68 secured with welds to the bottom of frame member 31. A roller or sleeve 69 is rotatably mounted on a bolt 71 attached to bracket 68. Strap 61 trained over roller 69 can move with roller 69 thereby reducing wear and strain on member 61. Anchor 67 has a U-shaped bracket 72 rotatably supporting a sleeve 73. Member 61 is wrapped around and secured to sleeve 73 to connect member 61 to sleeve 73 thereby anchoring member 61 to door frame 29. The slack or tension of strap 61 is adjusted with a ratchet ring 74 secured to sleeve 73. A holding panel 76 is held with a cotter pin 77 in engagement with the teeth on ring 74. Other devices can be used to adjust the slack or tension on strap 61. Flexible straps 62, 63 and 64 are trained over rollers operatively connected to frame member 31 and anchored to frame member 33 according to member 61 as shown in FIGS. 4, 5 and 6. The lower end of member 61 is connected to lift drum 78 secured to shaft 56. As shown in FIG. 7, disks 79 and 81 attached to opposite ends of drum 78 maintain member 61 in wrapping relation around drum 78 during winding of strap 61 on drum 78 and unwinding of member 61 from drum 78. A reversible electric motor 82 drives a power transmission 83 operable to transmit power through chain drives 84 and 86 coupled to sprockets 87 and 88 to shaft 56 whereby shaft 56 is selectively rotated in opposite directions to move bi-fold door 22 to a folded open position and allow door 22 to move to a closed position. Shaft 56 is rotated in a counterclockwise direction, shown by arrow 89, to wind strap 61 around drum 78 to move door 22 to the open folded position. Lift drums 91, 92 and 93, shown in FIG. 3, secured to shaft 56 accommodates flexible straps 62, 63 and 64 and concurrently wind and unwind flexible straps 62, 63 and 64 on drums 91, 92 and 93 as flexible strap 61 winds and unwinds on drum 78. Limit switches (not shown) associated with electric motor 82 and transmission 83 control the duration or timing of the operation of electric motor 82.

Figure 8:
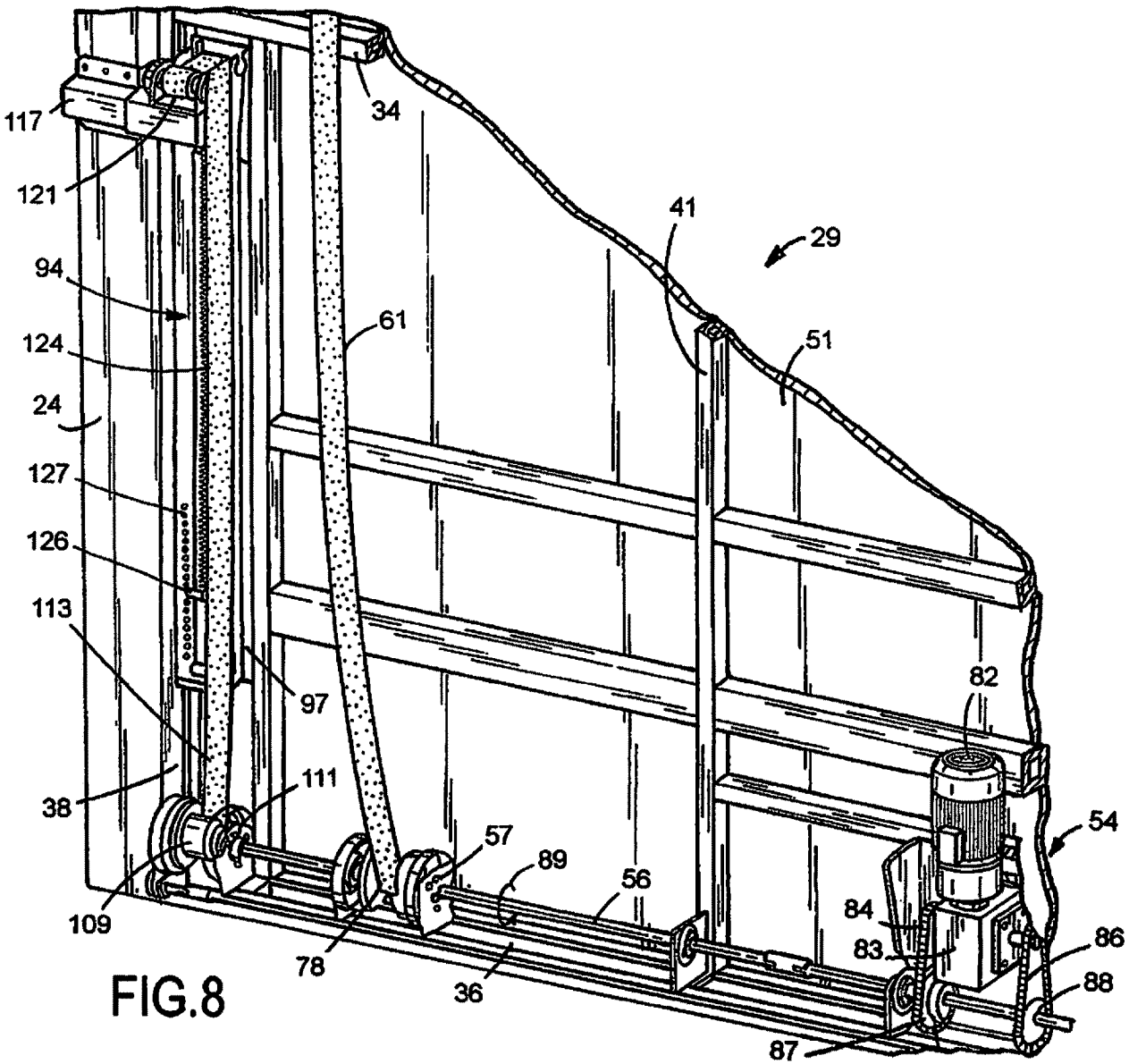
FIG. 8 is an enlarged perspective view of a section of the bi-fold door having a door lift mechanism combined with a latch assembly.
Figures 9, 10, 11, 12, 13:
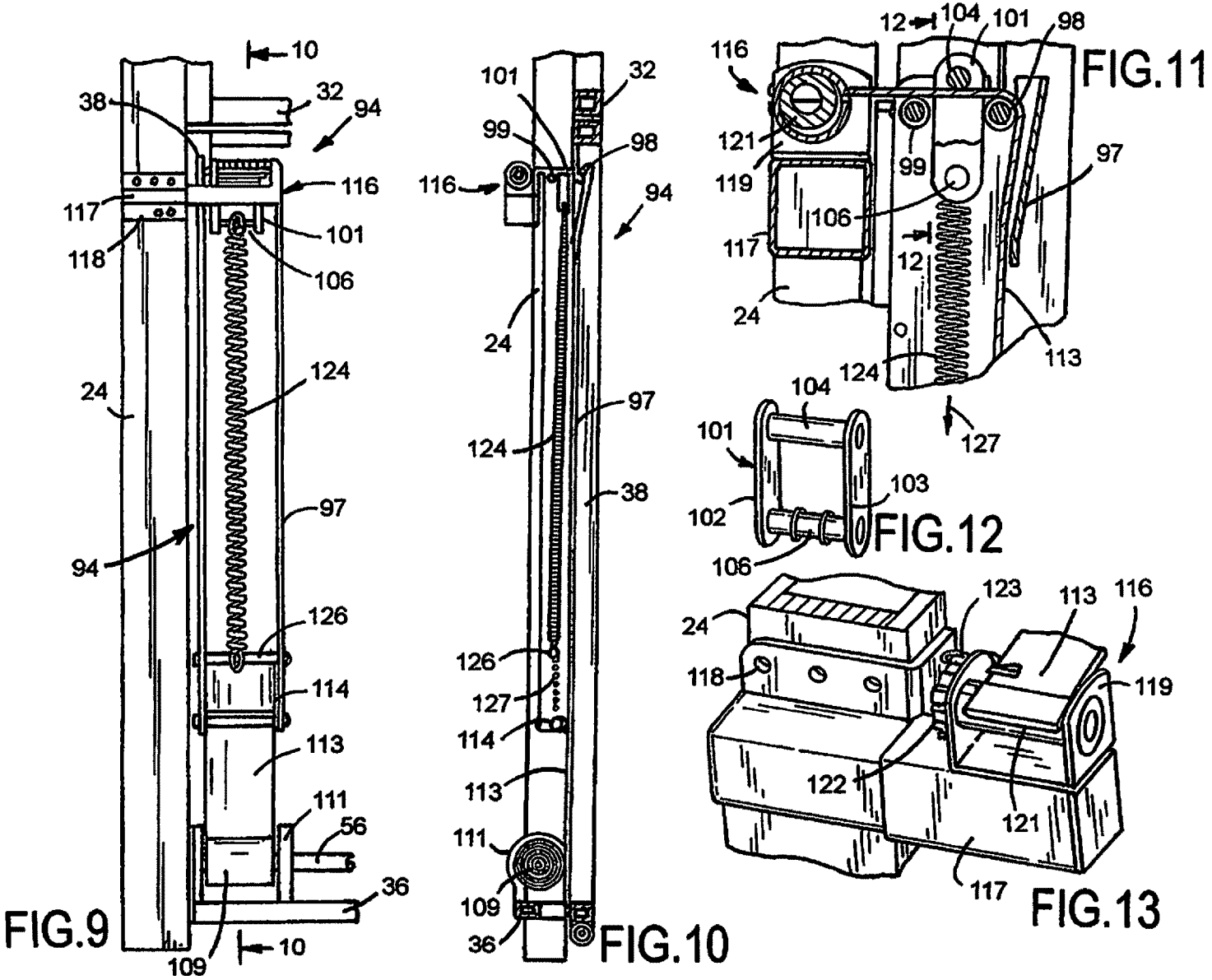
FIG. 9 is an enlarged sectional view of a latch assembly for moving and holding the bi-fold door in the closed position.
FIG. 10 is a sectional view taken along line 10-10 of FIG. 9.
FIG. 11 is an enlarged elevational view, partly sectioned, of the upper end of the latch assembly shown in FIGS. 9 and 10.
FIG. 12 is a sectional view taken along line 12-12 of FIG. 11.
FIG. 13 is a perspective view of the strap ratchet and bracket assembly of the latch assembly.

Latch assemblies 94 and 96 mounted on opposite ends of frame 29 are operable to move panels 27 and 28 in upright or vertically aligned positions and retain panels 27 and 28 in engagement with columns 24 and 26 when door 22 is in the closed position. As shown in FIGS. 8, 9 and 10, latch assembly 94 secured to door frame 29 adjacent column 24 comprises an upright U-shaped frame 97. Frame 97 is fastened with welds to frame member 38 and adjacent frame members. Other types of fasteners can be used to attach frame 97 to door frame 29. A pair of horizontal rollers 98 and 99 are mounted on the upper end of frame 97. Rollers 98 and 99 are parallel and laterally spaced apart to accommodate a roller bracket assembly 101. As shown in FIG. 12, roller bracket assembly 101 has upright flat side members 102 and 103 connected to an upper pin or rod 104 and a lower pin or rod 106. A latch drum 109 located below frame 97 is rotatably mounted on supports 111 secured to door frame member 36. Shaft 56 is drivably connected to drum 109 to rotate drum 109 when driven by electric motor 82. Rotation of shaft 56 concurrently rotates lift drums 78, 91, 92 and 93 and latch drums 109 and 112 to move bi-fold door 22 to the upright closed position and retain bi-fold door 22 in the upright closed position. A latch strap 113 attached to latch drum 109 extends upward into U-shaped frame 97 between a roller 114 and back wall of frame 97. The upper section of strap 113 extends horizontally over rollers 98 and 99 to a strap anchor 116. As shown in FIG. 13, anchor 116 has a bracket 117 secured with fasteners 118 to column 24. A U-shaped support 119 secured to bracket 117 rotatably accommodates a sleeve 121. Strap 113 is secured to sleeve 121 as shown in FIG. 11. Strap 113 is wound around sleeve 121 to adjust the effective length of strap 113 to retain bi-fold door 22 in the upright closed position. A ratchet wheel 122 secured to sleeve 121 is used with a tool (not shown) to rotate sleeve 121 to wind strap 113 on sleeve 121. A pin 123 fixed to support 119 engages ratchet wheel 122 to hold ratchet wheel 122 and sleeve 121 in an adjusted position with strap 113 wound on sleeve 121. A tension spring 124 has a lower end connected to a bolt 126 extended through holes 127 in latch frame 97. As shown in FIG. 10, latch frame 97 has a plurality of vertically arranged holes 127 accommodating bolt 126 for adjusting the biasing force of spring 124 on strap 113, shown by arrow 127 in FIG. 11. The upper end of spring 124 is connected to pin 106 of roller bracket assembly 101. Pin 104 located on top of strap 113 between rollers 98 and 99 applies the biasing force of spring 124 to pull strap 113 down between rollers 98 and 99 to take up slack of strap 113 and maintain the tension on strap 113 during the opening and closing of bi-fold door 22.

Figure 3:
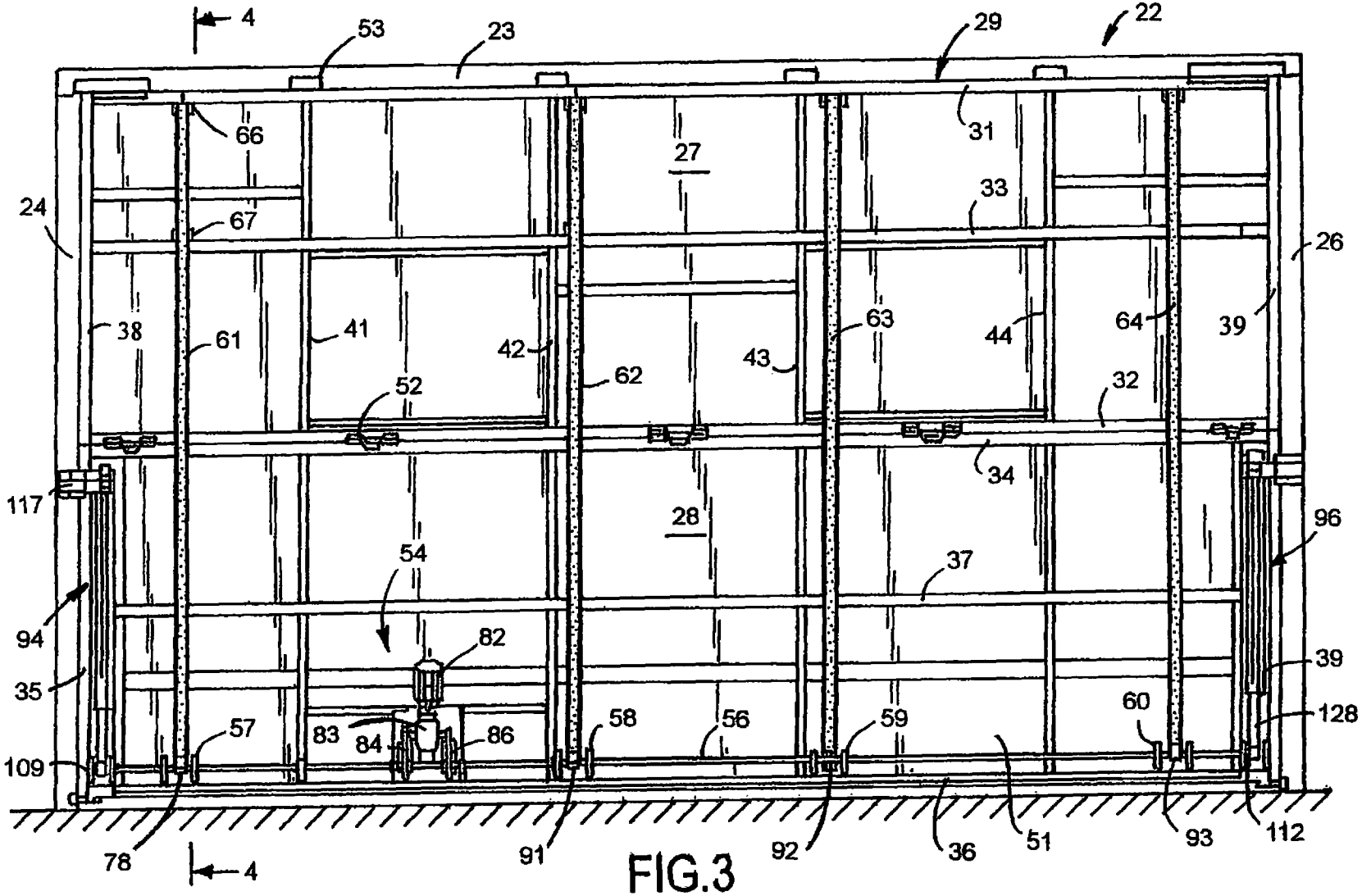
FIG. 3 is an inside elevational view of a bi-fold door having a door lift mechanism combined with a latch assembly.
Figure 4:
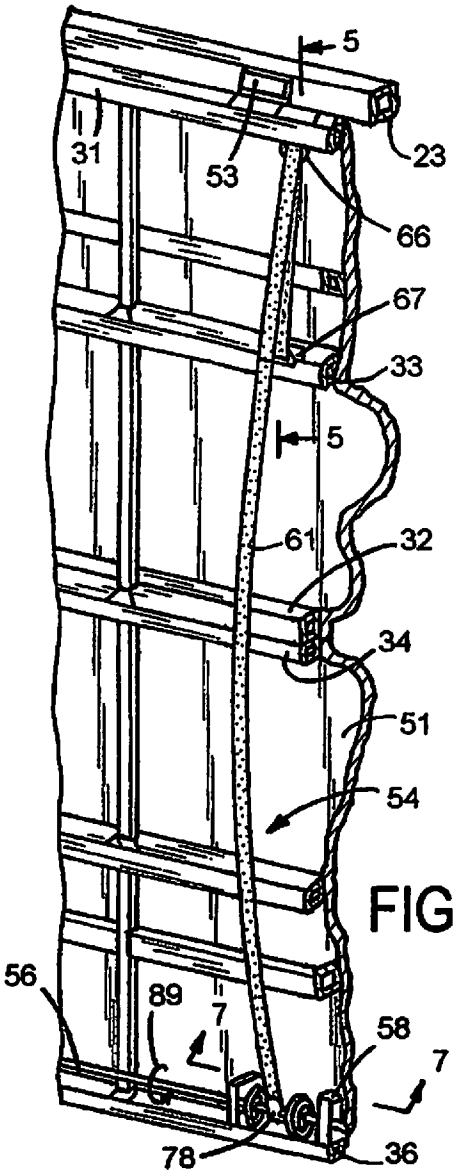
FIG. 4 is a perspective view of the door lift strap assembly on a closed upright bi-fold door.
Figure 14:
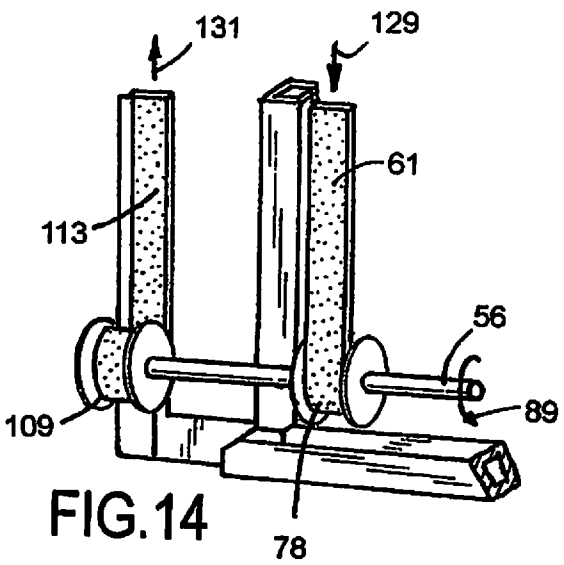
FIG. 14 is a perspective view of the lift drum and latch drum connected to a drive shaft accommodating lift and latch straps.
Figure 15:
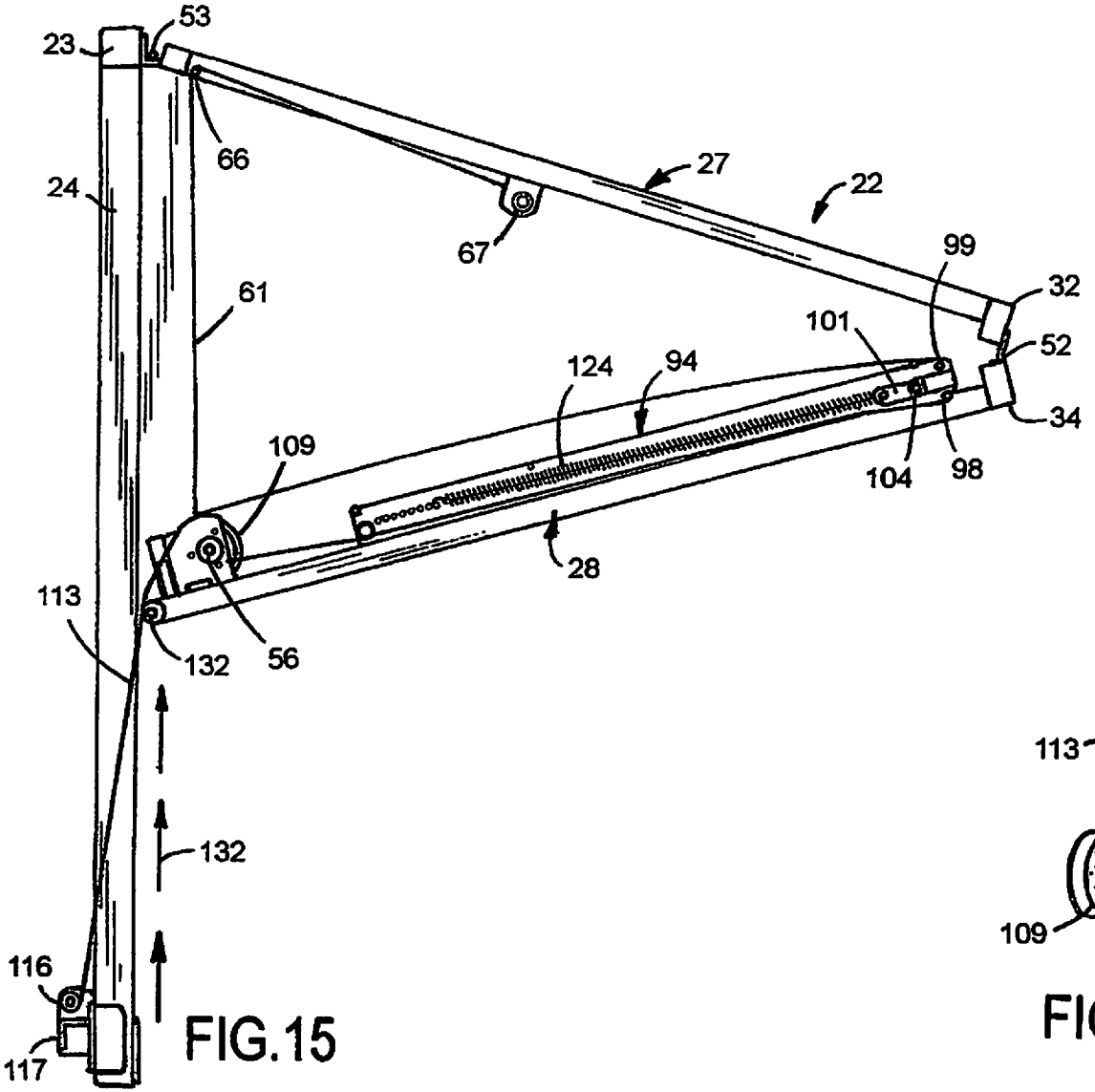
FIG. 15 is a side elevational view showing the bi-fold door being moved to the folded open position.

Latch assembly 96 mounted on the right end of door 22, as shown in FIG. 3, has the same structure and operation as latch assembly 96. Shaft 56 is drivably connected to latch drum 112 to rotate latch drum 112 whereby strap 128 is wound on and unwound from latch drum 112 during the opening and closing of bi-fold door 22 and the latching and unlatching functions of latch assembly 96. As shown in FIG. 14, when shaft 56 is rotated counterclockwise, shown by arrow 89, strap 61 is wound on drum 78. Straps 62, 63 and 64 are also wound on drums 91, 92 and 93. The combined straps 61, 62, 63 and 64 move down, shown by arrow 129, thereby moving bi-fold door 22 from the closed position to the folded open position. During counterclockwise rotation of shaft 56 latch drum 109 unwinds strap 113 from drum 109 whereby strap 113 moves upward releasing the horizontal force holding bi-fold door 22 in the closed position and allowing the bi-fold door to move upwardly to the open position, as shown by arrows 132 in FIG. 15. Strap 113 rides on roller 132 on the bottom of frame member 36 during movement of bi-fold door 22 between open and closed positions. Spring 124 connected to roller bracket assembly 101 maintains a continuous biasing force on strap 113 during the opening and closing of bi-fold door 22. Shaft 56 is rotated in a clockwise direction by reversing the drive of electric motor 82. Straps 61, 62, 63 and 64 unwind from lift drums 78, 91, 92 and 93 allowing bi-fold door 22 to unfold from the open position to an upright closed position. The weight of bi-fold door 22 causes bi-fold door 22 to move down as straps 61-64 unwind from their respective drums. Strap 113 as it winds onto drum 109 pulls bi-fold door 22 to an upright closed position, as shown in FIG. 10. When bi-fold door 22 is in the closed position, spring 124 acting on strap 113 biases bi-fold door 22 against column 24 and maintains bi-fold door 22 in the upright closed position.

An alternative embodiment of the bi-fold door having lift mechanisms and automatic latch assemblies is shown in FIGS. 16 to 22. Bi-fold door 200 has an upper panel 221 and a lower panel 222 located in general vertical orientation closing doorway passage or opening in an exterior wall of building 20. Panels 221 and 222 are rectangular framed structures having exterior sheeting, such as wood, plastic, metal and the like. Bi-fold door 200 has a plurality of center hinges 227 pivotally connecting adjacent horizontal frame members of panels 221 and 222 to allow panels 221 and 222 to fold upwardly, as shown in FIG. 2, to an open side-by-side position adjacent the top of the doorway opening. Top frame member 228 of upper panel 221 is secured to a header 230 of the building wall with a plurality of hinges 229.

Figure 16:
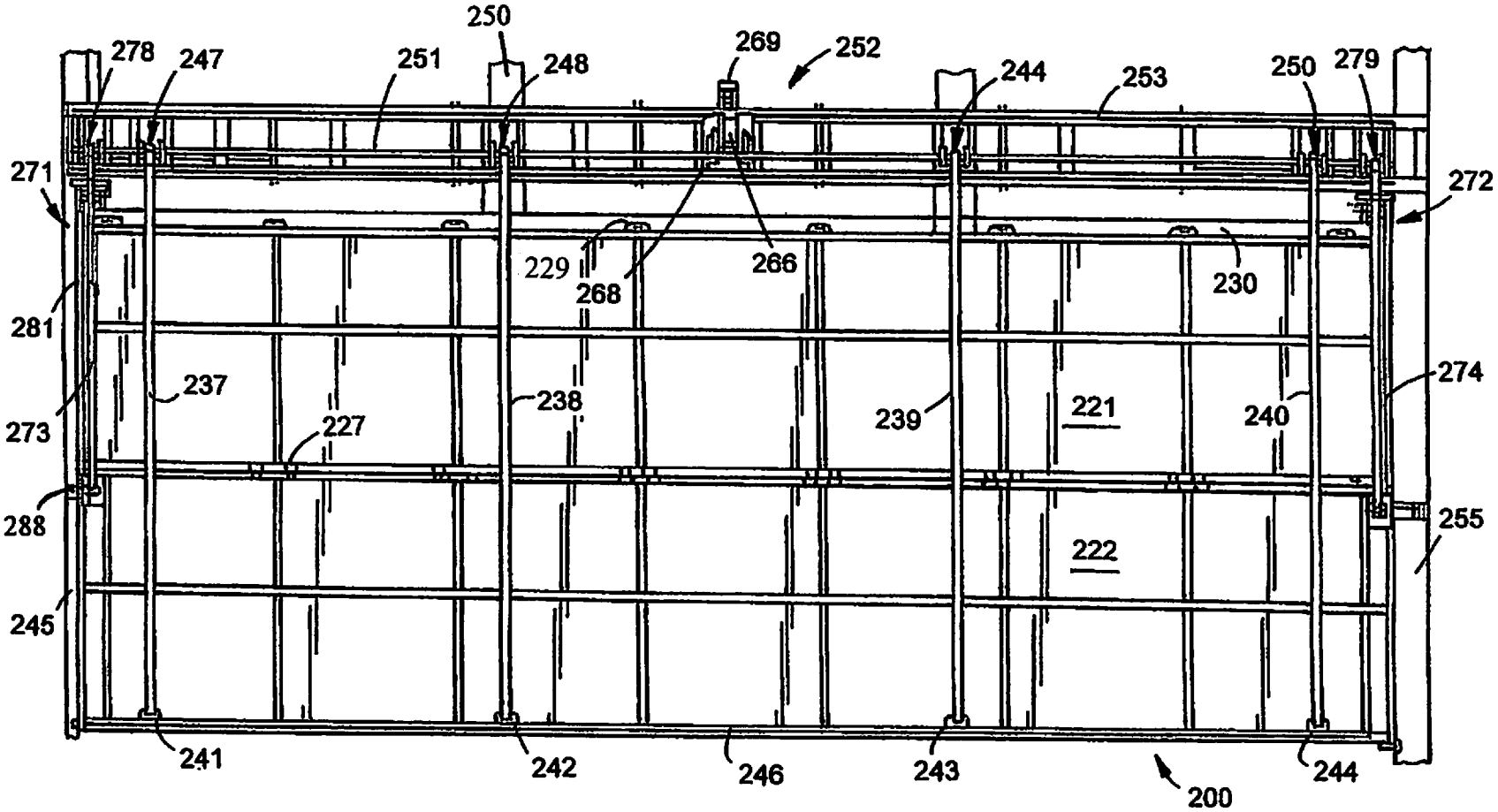
FIG. 16 is an inside elevational view of a bi-fold door and combined door lift mechanism and latch assemblies for locating the bi-fold door in an upright closed position.

As shown in FIG. 16, bi-fold door 200 is selectively moved to its open and closed positions with door lift devices indicated generally at 233, 234, 235 and 236 spaced along the length of bi-fold door 200. Door lift devices 233, 234, 235 and 236 have elongated flexible members, such as webs or straps 237, 238, 239 and 240 attached to anchors 241, 242, 243 and 244 mounted on bottom frame member 246 of lower panel 222 and lift drums 247, 248, 249 and 250 mounted on a frame member 253 of upper panel 221. Upper panel 221 and lower panel 222 of bi-fold door 200 are maintained in the vertically aligned closed position with door latch assemblies indicated generally at 271 and 272 located on opposite ends of bi-fold door 200. Door latch assemblies 271 and 272 have elongated flexible webs or straps 273 and 274 located on rollers 275 and attached to anchors 276 and 277 mounted on the top portion of lower panel 222 and latch drums 278 and 279 mounted on upper frame 253. Straps 273 and 274 are wrapped on latch drums 278 and 279 in an opposite direction from the direction straps 237-240 are wrapped on lift drums 247-250.

Straps 237-240, 273 and 274 are elongated flexible, generally flat and substantially non-elastic members having a width between two and six inches and being made of plastic and fiber materials, such as nylon webs, polyester webs and the like. Other types of materials can be used to make straps 237-240, 273 and 274. Straps 237-240, 273 and 274 can have other sizes and widths to accommodate different loads and latching requirements of bi-fold door 200.

Figure 17:
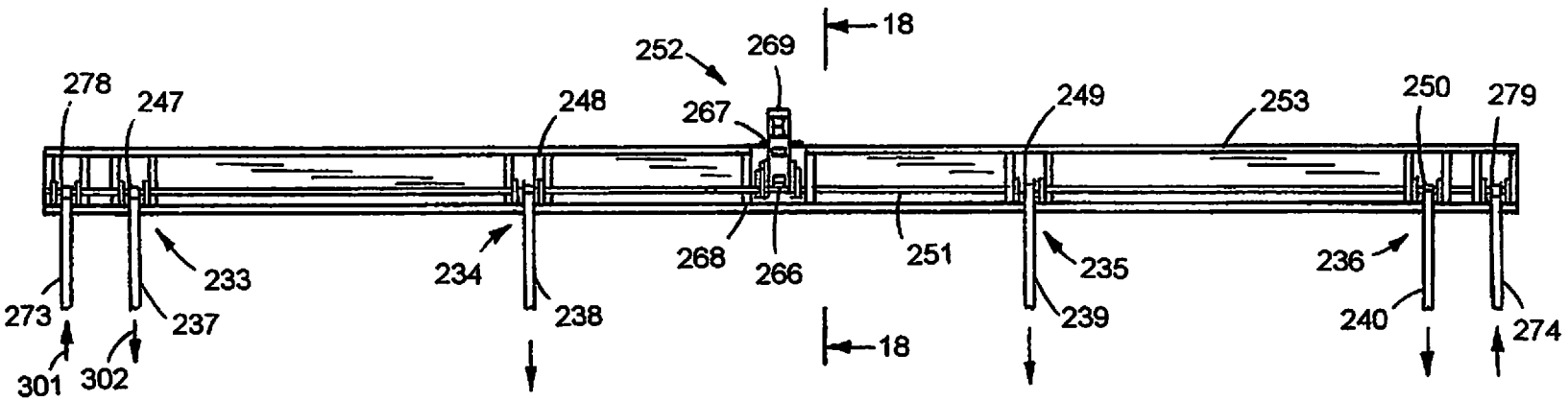
FIG. 17 is an elevational view of the combined door lift power drive apparatus rotating lift drums and latch drums.

As shown in FIG. 17, a drive shaft 251 mounted on frame 253 is rotated with a power unit 252 to concurrently rotate lift drums 247-250 and latch drums 278 and 279 to wind straps 237-240 on lift drums 247-250 and allow straps 273 and 274 to unwind from latch drums 278 and 279 to unlatch and move bi-fold door 200 to its open position and wind straps 273 and 274 on latch drums 278 and 279 and allow straps 237-240 to unwind from lift drums 247-250 to move door 200 to its upright closed position and latch door 200 secure to the building columns. Drive shaft 251 extends the length of frame 253. Latch drums 278 and 279 are mounted on opposite ends of frame 253 outwardly from lift drums 247 and 250. Frame 253 is attached to the building structure above header 230.

Door lift devices 231-236 are identical in structure and function. The details of lift device 233, shown in FIGS. 17 to 22, are included in lift devices 234-237. The following description is directed to lift device 233. Power unit 252 mounted on frame 253, shown in FIGS. 16 and 18, includes a power transmission or gear box 266 driven with a reversible electric motor 269. An electric brake unit 267 locks gear box 266 when the electric power to motor 269 is turned off thereby preventing rotation of drive shaft 251. Motor 269 rotates drive shaft 251 connected to lift drums 247-250 and latch drums 278 and 279 to concurrently rotate lift drums 247-250 and latch drums 278 and 279 in opposite rotational directions to open and close bi-fold door 200 and latch bi-fold door 200 to the doorway columns. Gear box 266 is driveably connected to drive shaft 251 to selectively rotate drive shaft 251 in clockwise and counterclockwise directions thereby concurrently rotating lift drums 247-250 and latch drums 278 and 279 in clockwise and counterclockwise directions to open bi-fold door 200 and close and latch bi-fold door 200 secure to the doorway columns. A jack shaft chain and sprocket drive 268 is used to operatively connect gear box 266 with drive shaft 251. A manually operated switch (not shown) wired to motor 269 is used by an operator to control the electric power supplied to motor 269 and the opening, closing and latching of bi-fold door 200.

Figure 19:
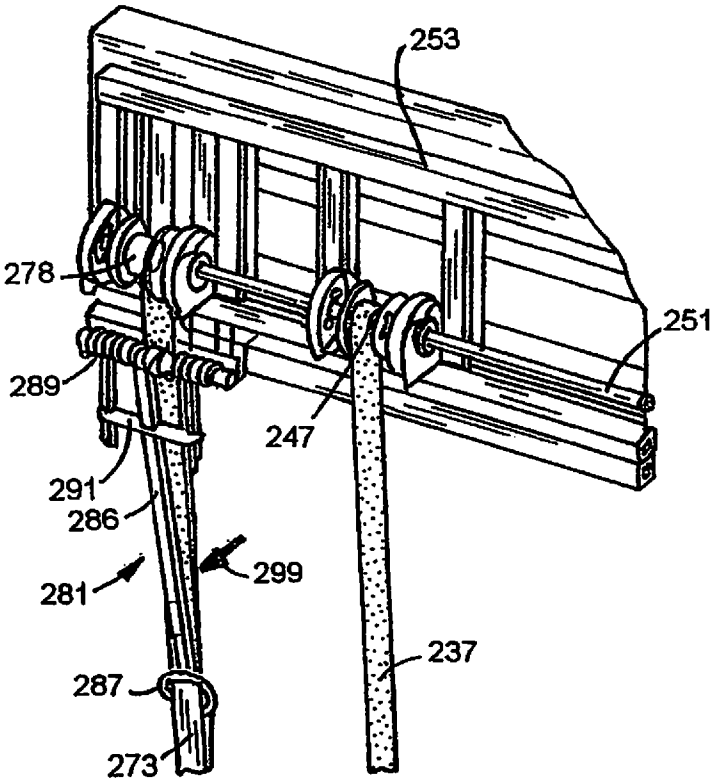
FIG. 19 is a perspective view of the lift drums and latch drums on the frame accommodating lift and latch straps.
Figure 18:
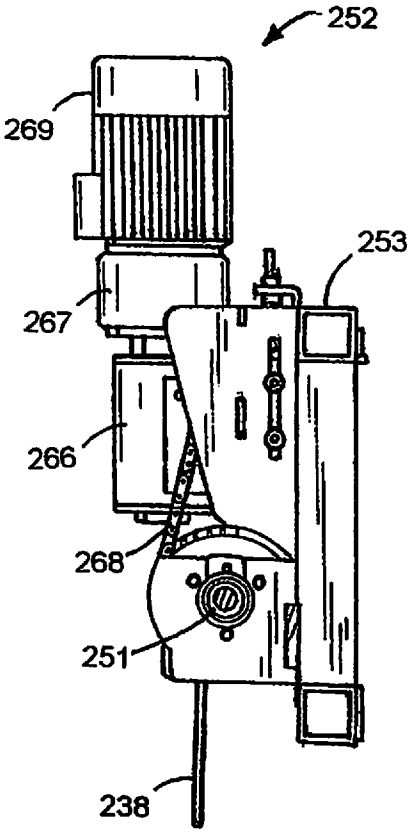
FIG. 18 is an enlarged sectional view taken along line 18-18 of FIG. 17.
Figure 21:
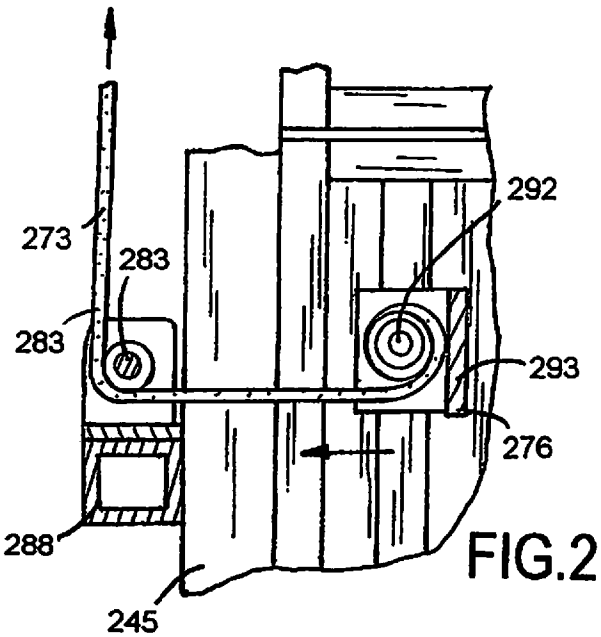
FIG. 21 is a sectional view taken along line 21-21 of FIG. 20.

As shown in FIG. 16, strap 237 extends downwardly from lift drum 247 to anchor 241 mounted on bottom frame member 246 of lower panel 222. The free end of strap 237 is attached to anchor 241. Anchor 241 can be adjusted to take up slack of strap 237 to adjust the operating or working length of strap 237 as needed. As seen in FIG. 19, lift drum 247 is mounted on frame member 253. Lift drum 247 has a generally cylindrical outer surface providing a drum surface for strap 237.

Door latch devices 271 and 272 are identical in structure and function. The details of door latch device 271, shown in FIGS. 19 to 22, are included in door latch device 272. The following description is directed to door latch device 271.

Figure 22:
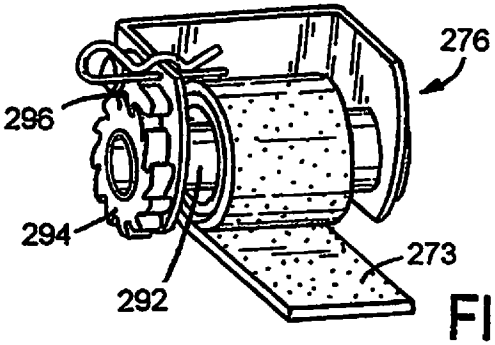
FIG. 22 is a perspective view of a latch strap ratchet anchor accommodating the latch strap.
Figure 20:
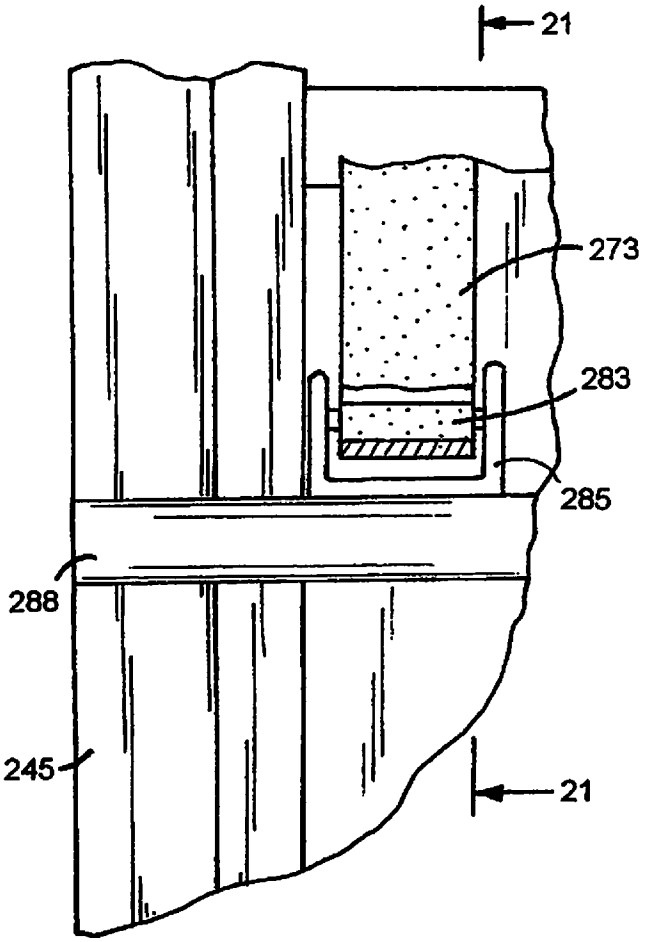
FIG. 20 is an enlarged elevational view of the latch strap roller assembly secured to a column of the building.

As shown in FIG. 16, strap 273 extends downwardly from latch drum 278 through a kick out arm assembly 281 mounted on frame 253. Kick out arm assembly 281 comprises a downward extending arm 286 having a lower end with a straight eye 287. Strap 273 extends through the opening of eye 287 downwardly to a roller 283 mounted on support 285 attached to a bracket 288 secured to column 245 of the building. Strap 273 is trained over roller 283 and extends laterally to anchor 276 mounted on the frame of lower panel 222. Arm assembly 281 has a spring member 289 that engages a horizontal bar member 291 to bias arm member 286 upwardly and inwardly away from the inside of bi-fold door 200, as shown by arrow 299 in FIG. 19, thereby maintaining tension on strap 273 during opening and closing of bi-fold door 200. As seen in FIG. 22, anchor 276 has a sleeve 292 mounted on a support 293 secured to lower panel 221. A ratchet wheel 294 and pawl 296 operate to hold sleeve 292 in a fixed position on support 293.

In use, when bi-fold door 200 is moved from an open position to the closed latched position lift drums 247-250 are releasing straps 237-240 and latch drums 278 and 279 are taking up straps 273 and 274, as shown by arrows 301 and 302 in FIG. 17. When bi-fold door 200 is moved from the closed latched position to the open position latch drums 278 and 279 are releasing straps 273 and 274 and lift drums 247-250 are taking up straps 237-240. As bi-fold door 200 is moved from the closed latched position to the open position slack in straps 273 and 274 is taken up with kick out arm assemblies 281 and 282. When bi-fold door 200 is fully closed latch drums 278 and 279 are filled with straps 273 and 274 and lift drums 247-250 are left with a small amount of straps 237-240. Brake unit 267 locks gear box 266 when motor 269 is turned off whereby latch drums 278 and 279 are prevented from rotating and releasing straps 273 and 274 to maintain upper and lower panels 221 and 222 in a vertically aligned closed latched position secure to the building. As bi-fold door 200 is unlatching and opening straps 237-240 are wrapped onto lift drums 247-250 while straps 273 and 274 are unwound off latch drums 278 and 279. Straps 273 and 274 add support to bi-fold door 200 preventing flipping of door 200 over the roof of the building in windy conditions.

The following drawing and description of the bi-fold door having latch assemblies is two embodiments of the invention. Persons skilled in the art of bi-fold doors can make changes and modifications in structures and materials without departing from the invention defined in the claims.

The invention claimed is:

1. A door latch assembly for holding upper and lower panels of a bi-fold door in an aligned position in engagement with an upright column of a building comprising:

an elongated flexible member having a first end and a second end, a rotatable latch drum configured to be operatively attached to the building above the upper panel of the bi-fold door, the first end of the flexible member connected to the latch drum whereby on rotation of the latch drum the flexible member selectively winds around and unwinds from the latch drum, a support configured to be connected to the upright column, a roller mounted on the support, said flexible member being engageable with the roller mounted on the support, an anchor configured to be secured to the bi-fold door, said anchor including a connector securing the second end of the flexible member to the anchor whereby on rotation of the latch drum in a first direction the flexible member is wound on the latch drum and moves and retains the upper and lower panels of the bi-fold door into the aligned position in engagement with the upright column and on rotation of the latch drum in a second direction opposite the first direction the flexible member unwinds from the latch drum to allow the upper and lower panels of the bi-fold door to move from the aligned position in engagement with the upright columns to a side-by-side position spaced from the upright columns, the connector securing the second end of the flexible member to the anchor comprises a sleeve rotatably mounted on the anchor, the second end of the flexible member being secured to the sleeve whereby rotation of the sleeve winds the second end of the flexible member on the sleeve, and a device for holding the sleeve in a selected fixed position on the anchor.

2. The door latch assembly of claim 1 wherein:

the anchor is configured to be secured to the lower panel of the bi-fold door.

3. The door latch assembly of claim 1 wherein:

the roller is rotatably mounted on the support, said flexible member being engageable with the roller to direct the flexible member to the anchor.

4. The door latch assembly of claim 1 wherein:

the elongated flexible member is an elongated flexible strap.

5. The door latch assembly of claim 1 including:

a kick-out device including an arm having an end, the end of the arm having an opening, the flexible member extending through the opening, and a spring engaging the arm to bias the arm and the flexible member away from the bi-fold door.

6. The door latch assembly of claim 1 including:

a frame attachable to the building above the upper panel of the bi-fold door, and the latch drum being rotatably mounted on the frame.

7. A door latch assembly for holding a bi-fold door in an upright closed position in engagement with an upright column comprising:

an elongated flexible member, a rotatable latch drum connected to the elongated flexible member, a first member operable to selectively rotate the latch drum in a first direction and a second direction opposite the first direction, a support configured to be connected to the upright column, a second member mounted on the support and engageable with the elongated flexible member, an anchor configured to be secured to the bi-fold door, and said anchor including a connector securing the elongated flexible member whereby on rotation of the latch drum in the first direction the elongated flexible member is wound on the latch drum to move and hold the bi-fold door in the upright closed position in engagement with the upright column, and on rotation of the latch drum in the second direction the elongated flexible member unwinds from the latch drum to allow the bi-fold door to move from the upright closed position and out of engagement with the upright column to an open position, the connector securing the elongated flexible member to the anchor comprises a sleeve rotatably mounted on the anchor and secured to the elongated flexible member, and a device for holding the sleeve in a selected position on the anchor.

8. The door latch assembly of claim 7 wherein:

the second member mounted on the support comprises a roller rotatably attached to the support for engaging the elongated flexible member and directing the elongated flexible member to the connector of the anchor.

9. The door latch assembly of claim 7 wherein:

the elongated flexible member is an elongated flexible strap.

10. The door latch assembly of claim 7 including:

a kick-out device including an arm having an end, the end of the arm having an opening, the elongated flexible member extending through the opening, and a spring engaging the arm to bias the arm and the elongated flexible member away from the bi-fold door.

11. The door latch assembly of claim 7 including:

a frame located above the bi-fold door, said first member being mounted on the frame whereby the latch drum is located above the bi-fold door.

12. A door latching apparatus for holding a bi-fold door in a closed position with a first upright column and a second upright column laterally spaced from the first upright column comprising:

a first elongated flexible member, a second elongated flexible member, a rotatable first latch drum, said first elongated flexible member being connected to the first latch drum whereby on rotation of the first latch drum in a first direction winds the first elongated flexible member on the first latch drum and rotation of the first latch drum in a second direction opposite the first direction unwinds the elongated first flexible member from the first latch drum, a rotatable second latch drum, said second elongated flexible member being connected to the second latch drum whereby on rotation of the second latch drum in a first direction winds the second elongated flexible member on the second latch drum and rotation of the second latch drum in a second direction opposite the first direction unwinds the second flexible member from second latch drum, a first support configured to be mounted on the first upright column, a first anchor configured to be secured to the bi-fold door adjacent the first support, said first elongated flexible member being engageable with the first support and connected to the first anchor, a second support configured to be mounted on the second upright column, a second anchor configured to be secured to the bi-fold door adjacent the second support, said second elongated flexible member being engageable with the second support and connected to the first anchor, and a member operable to concurrently rotate the first latch drum in a first direction to wind the first elongated flexible member on the first latch drum and rotate the second latch drum in the first direction to wind the second elongated flexible member on the second latch drum whereby the first elongated flexible member and the second elongated flexible member concurrently move and hold the bi-fold door in engagement with the first upright column and the second upright column, the first anchor including a first connector mounted on the first anchor and attached to the first elongated flexible member, the second anchor including a second connector mounted on the second anchor and attached to the second elongated flexible member, the first connector comprises a first sleeve rotatably mounted on the first anchor, and a first device for holding the first sleeve in a selected position on the first anchor, the second connector comprises a second sleeve rotatably mounted on the second anchor, and a second device for holding the second sleeve in a selected position on the second anchor.

13. The door latching apparatus of claim 12 wherein:

the first elongated flexible member is a first elongated flexible strap, and the second elongated flexible member is a second elongated flexible strap.

14. The door latching apparatus of claim 12 wherein:

the first support includes a first roller engageable with the first elongated flexible member, and the second support includes a second roller engageable with the second elongated flexible member.

15. The door latching apparatus of claim 12 wherein:

the first elongated flexible member is a first elongated flexible strap, and the second elongated flexible member is a second elongated flexible strap.

16. The door latching apparatus of claim 12 including:

a first kick-out device having a first arm accommodating the first elongated flexible member, a first spring engageable with the first arm to bias the first arm and the first elongated flexible member away from the bi-fold door, a second kick-out device having a second arm accommodating the second elongated flexible member, and a second spring engageable with the second arm to bias the second arm and the second elongated flexible member away from the bi-fold door.

* * * * *